US006902260B2

(12) United States Patent
Aschoff et al.

(10) Patent No.: US 6,902,260 B2
(45) Date of Patent: Jun. 7, 2005

(54) FLUID EJECTION DEVICE ADHERENCE

(75) Inventors: Chris Aschoff, Corvallis, OR (US); Paul F. Reboa, Corvallis, OR (US); Pamela Woody, Corvallis, OR (US); Yi Feng, San Diego, CA (US); Terry M. Lambright, Corvallis, OR (US); Leo Clarke, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 19 days.

(21) Appl. No.: 10/626,065

(22) Filed: Jul. 24, 2003

(65) Prior Publication Data

US 2005/0018018 A1 Jan. 27, 2005

(51) Int. Cl.[7] ..... B41J 2/05
(52) U.S. Cl. ..... 347/63
(58) Field of Search ..... 347/63, 56, 64, 347/61, 54, 84, 70, 68, 69, 71, 72, 94; 216/27, 4, 48; 29/890.1; 430/311

(56) References Cited

U.S. PATENT DOCUMENTS

| | | | | |
|---|---|---|---|---|
| 4,678,529 | A | 7/1987 | Drake et al. | |
| 4,683,481 | A | 7/1987 | Johnson | |
| 5,751,324 | A | 5/1998 | Brandon et al. | |
| 6,215,946 | B1 | 4/2001 | Sherrer | |
| 6,561,633 | B2 * | 5/2003 | Usui | 347/70 |
| 2002/0030720 | A1 | 3/2002 | Kawamura et al. | |

FOREIGN PATENT DOCUMENTS

| | | |
|---|---|---|
| EP | 0 795 406 | 9/1997 |

OTHER PUBLICATIONS

Hewlett–Packard, Co. U.S. Appli. Ser. No. 10/262,406, filed Sep. 30, 2002.

American Society for Precision Engineering, Kaiji Sato et al., "Self–Alignment of of Microparts using Liquid Surface Tension–Examination of the Alignment Characteristics", 2000, pp. 345–348.

IMTEK– Institute for Microsystem Technology, Albert Ludwig University, Andreas Greiner et al., "Capillary Forces in Micro–Fluidic Self–Assembly".

Emerson & Cuming, Technical Data Sheet, AMICON E 1172 Fast Flow–Snap Cure Capillary Flow Underfill.

GPD Global, "Liquid Encapsulation Protects Electronic Components", Mar. 20, 2001, pp. 1–5.

L. Gopalakrishnan et al., "Encapsulant Materials for Flip–Chip Attach", pp. 1291–1297, copyright 1998 IEEE.

Loctite Electronics, "Materials for Semiconductor Packaging", pp. 1–19.

* cited by examiner

*Primary Examiner*—Raquel Yvette Gordon

(57) ABSTRACT

Fluid-ejection devices capable of ejecting fluid onto media and methods for their manufacture are provided. One embodiment includes adhering a fluid-ejecting substrate of the fluid-ejection device to a carrier of the fluid-ejection device by drawing an adhesive between the fluid-ejecting substrate and the carrier using capillary action.

52 Claims, 13 Drawing Sheets

FLUID EJECTION DEVICE ADHERENCE

BACKGROUND

A typical inkjet printer usually has a carriage that contains one or more fluid-ejection devices, e.g., print heads, capable of ejecting fluid, such as ink, onto media, such as paper. Print heads usually include a carrier and a fluid-ejecting substrate (or print die), e.g., formed from silicon or the like using semiconductor processing methods, such as photolithography or the like.

The print die is typically affixed to the carrier by an adhesive. In many applications, the carrier includes a plurality of ink delivery channels for directing the ink from the ink reservoir to the print die. A surface of the carrier surrounds each of the ink delivery channels and forms ribs on either side of each of the ink delivery channels. Moreover, print dies usually include a plurality of slots that receive the ink from the ink delivery channels and direct the ink to resistors of the print die. A portion of a surface of the print-die surface surrounds each of the slots and forms ribs on either side of each of the slots. The slots of the print die are typically aligned with the ink delivery channels, and each of the ribs of the print die respectively abuts one of the ribs of the carrier.

To affix a print die to a carrier, an adhesive is typically applied to ribs of the carrier and/or the ribs of the print die, e.g., using a capillary tube of a syringe. The ribs of the print die are aligned with the ribs of the carrier and are pressed into abutment with the ribs of the carrier. One problem with this is that adhesive can be forced from between the abutting ribs and into the ink delivery channels of the carrier and/or the slots of print die, causing a blockage to the flow of ink. To correct for this, the amount of adhesive applied to the ribs is often reduced, which can undesirably allow ink to pass from one slot to another or to leak from the print cartridge. Moreover, print dies are becoming smaller and thus print-die and carrier ribs are becoming smaller. For some applications, print-die and carrier-rib sizes are on the order of, or are smaller than, the diameter of the capillary tubes of the syringes used to apply the adhesives, making it difficult to apply adhesive to the ribs. For many applications, capillary tube diameters cannot be reduced any further because increased fluid flow friction associated with reducing the diameter will make it extremely difficult to produce adhesive flow through the capillary tube.

After the print die is affixed to the carrier, the electrical contacts of the print die are electrically connected to the electrical connectors of the carrier using the electrical interconnects. Since many types of ink are corrosive to the electrical contacts, connectors, and interconnects, an encapsulant is usually disposed on the electrical contacts, connectors, and interconnects to protect them from the ink. However, the electrical contacts, connectors, and interconnects are often located adjacent the orifices, and the encapsulant often flows over the orifices, causing the orifices to become clogged. Moreover, many inkjet printers employ a wiper for wiping ink residue from the orifices to prevent the residue from clogging the orifices or from misdirecting ejected ink drops. However, encapsulants often flow to and solidify at a location such that the encapsulant prevents the wiper from effectively cleaning some of the orifices.

SUMMARY

One embodiment of the present invention provides a method for manufacturing a fluid-ejection device capable of ejecting fluid onto media. The method includes adhering a fluid-ejecting substrate of the fluid-ejection device to a carrier of the fluid-ejection device by drawing an adhesive between the fluid-ejecting substrate and the carrier using capillary action.

DETAILED DESCRIPTION

In the following detailed description of the present embodiments, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that process, electrical or mechanical changes may be made without departing from the scope of the present invention. The following detailed description is, therefore, not to be taken in a limiting sense, and the scope of the present invention is defined only by the appended claims and equivalents thereof.

Figure 1:
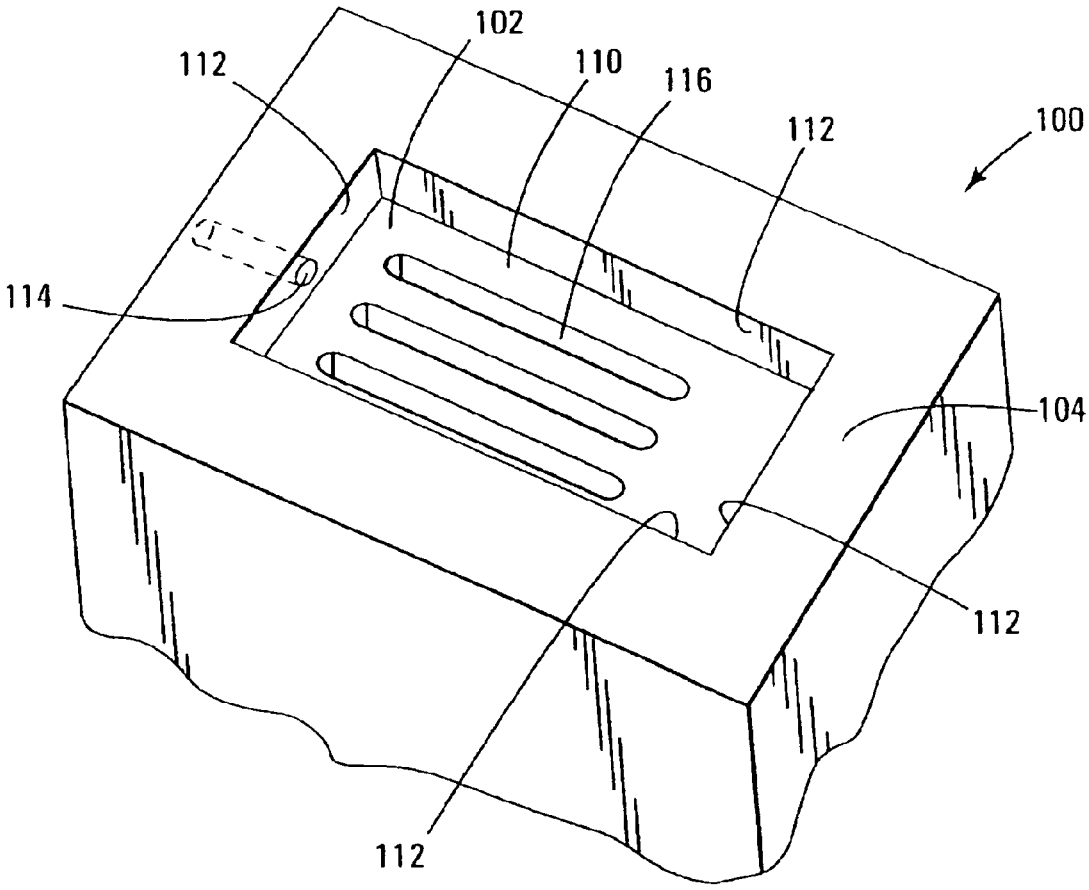
FIG. 1 is a perspective view of a carrier of a fluid-ejection device according to an embodiment of the present invention.

FIG. 1 illustrates a carrier 100 of a fluid ejection device, such as a print head, according to an embodiment of the present invention. Carrier 100 has a recess (or well) 102 in a surface 104. A surface 110 and walls 112 bound recess 102. For one embodiment, surface 110 is substantially parallel to surface 104, and walls 112 are substantially perpendicular to surfaces 104 and 110. In other embodiments, walls 112 are inclined between surfaces 102 and 110. For one embodiment, a flow passage 114 passes through a portion of carrier 100 and opens into recess 102 at one of walls 112. Surface 110 surrounds flow channels 116, e.g., ink delivery channels, of carrier 100 that open into recess 102 at surface 110. Carrier 100 can be fabricated from plastic, ceramic, silicon, or the like.

FIGS. 2–12 illustrate adhering a fluid-ejecting substrate 202 (e.g., a print-head die or substrate) to carrier 100 to form a fluid-ejection device 200 according to an embodiment of the present invention. Fluid-ejection device 200 is capable of ejecting fluid, e.g., ink, onto media, such as paper. For one embodiment, a gap 204 is formed between fluid-ejecting substrate 202 and carrier 100 by disposing spacers (or standoffs) 206 between a surface 212 fluid-ejecting substrate 202 and surface 110 of carrier 100. Examples of spacers 206 include permanent shims, removable shims, thin films disposed on carrier 100 by thin-film processing techniques, standoffs integral with carrier 100 formed by plastic injection or the like, small adhesive dots cured in place, metal posts, solder bumps, polymide tape, etc. For some embodiments, naturally occurring projections, e.g., that constitute roughness, on a surface 212 fluid-ejecting substrate 202 and surface 110 of carrier 100 can form gap 204. In some embodiments, gap 204 ranges from about 0.5 to about 150 microns.

Figure 4:
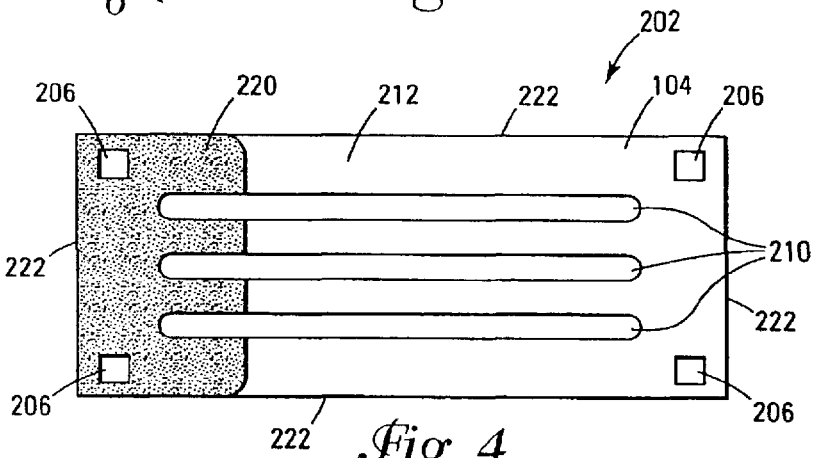
FIG. 4 is a view taken along line 4—4 of FIG. 3.
Figure 5:
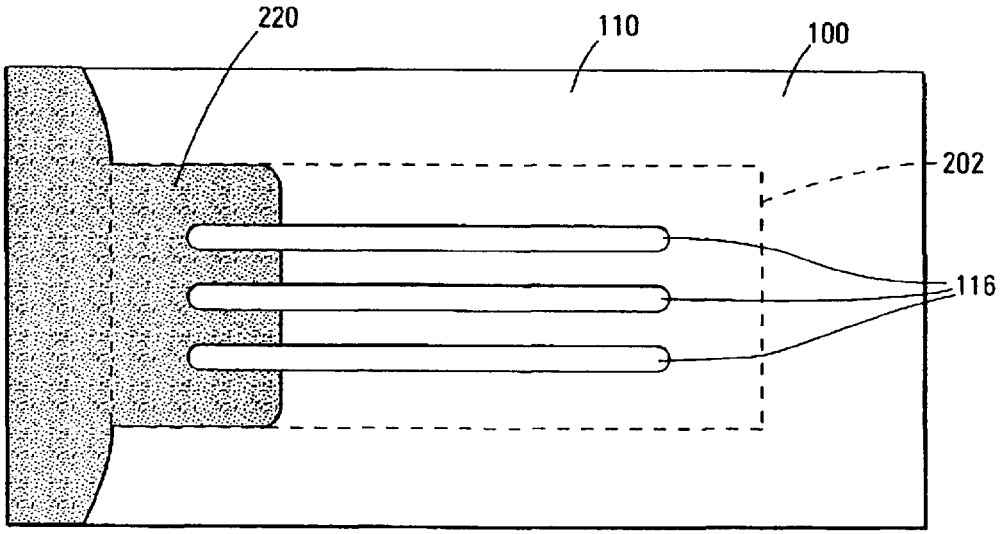
FIG. 5 is a view taken along line 5—5 of FIG. 3.
Figure 6:
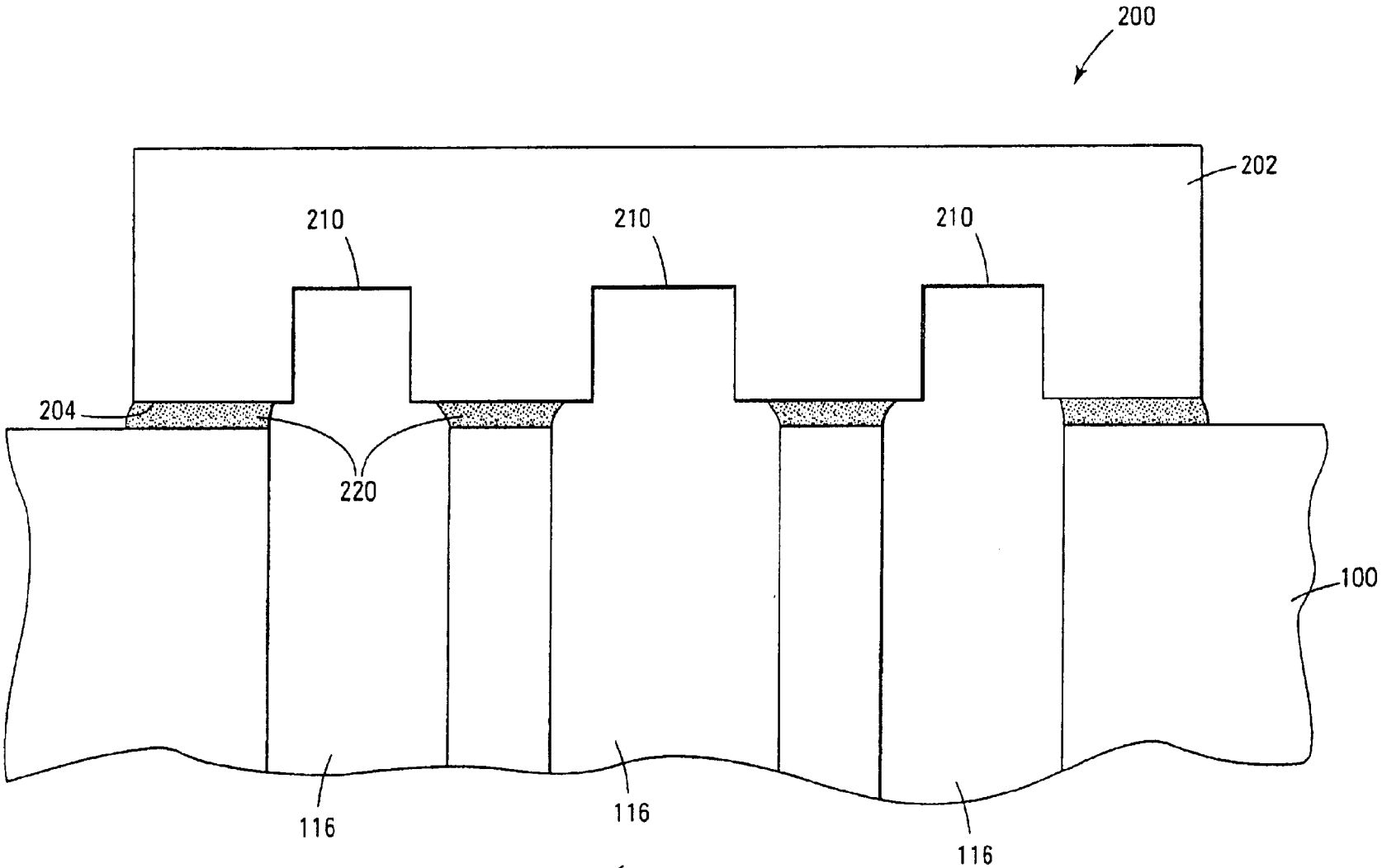
FIG. 6 is a view taken along line 6—6 of FIG. 3.

Fluid-ejecting substrate 202 includes slots 210 (FIG. 4) that respectively align with channels 116 (FIG. 5) when fluid-ejecting substrate 202 is disposed on carrier 100, as shown in FIG. 6. Moreover, surface 212 of fluid-ejecting substrate 202 surrounds each of slots 210, as shown in FIG. 4. For various embodiments, fluid-ejecting substrate 202 is formed from a semiconductor material, such as silicon or the like using semiconductor processing methods, such as photolithography or the like. Note that fluid-ejecting substrate 202 is shown as a dashed line on carrier 100 in FIGS. 5, 9, and 12 to illustrate positioning of fluid-ejecting substrate 202 on carrier 100.

Figure 2:
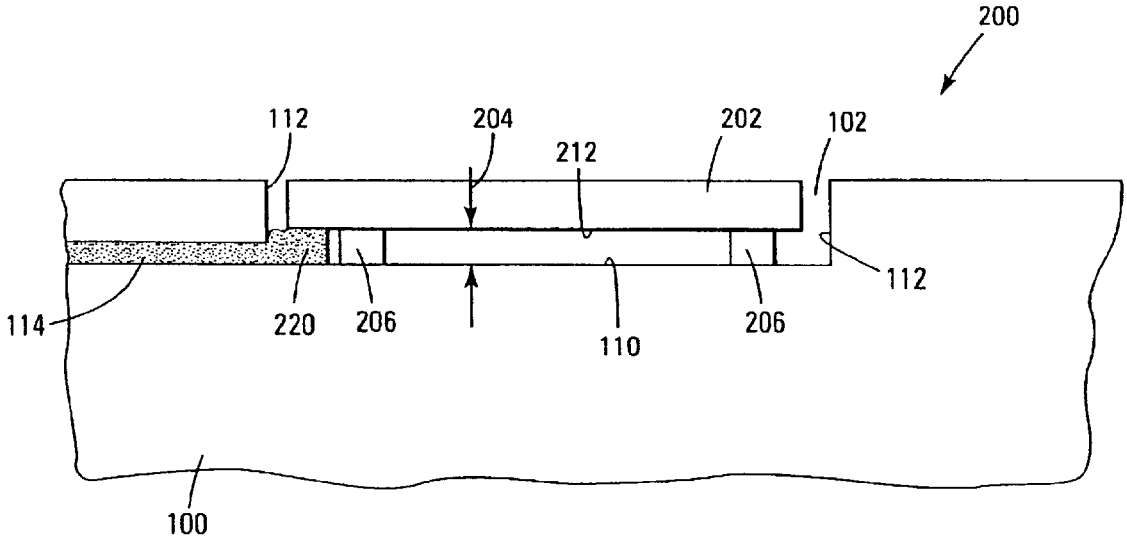
FIG. 2 is a cross-sectional view of a fluid-ejection device according to another embodiment of the present invention.

An adhesive 220 is disposed between fluid-ejecting substrate 202 and carrier 100 for adhering fluid-ejecting substrate 202 to carrier 100. For one embodiment, adhesive 220 is directed into recess 102 through flow passage 114, as shown in FIG. 2. In other embodiments, adhesive 220 is dispensed into recess using a syringe or the like. One suitable adhesive is available from Emerson & Cuming, Inc., Billerica, Mass., USA, as part numbers E1172 or E1216.

Figure 3:
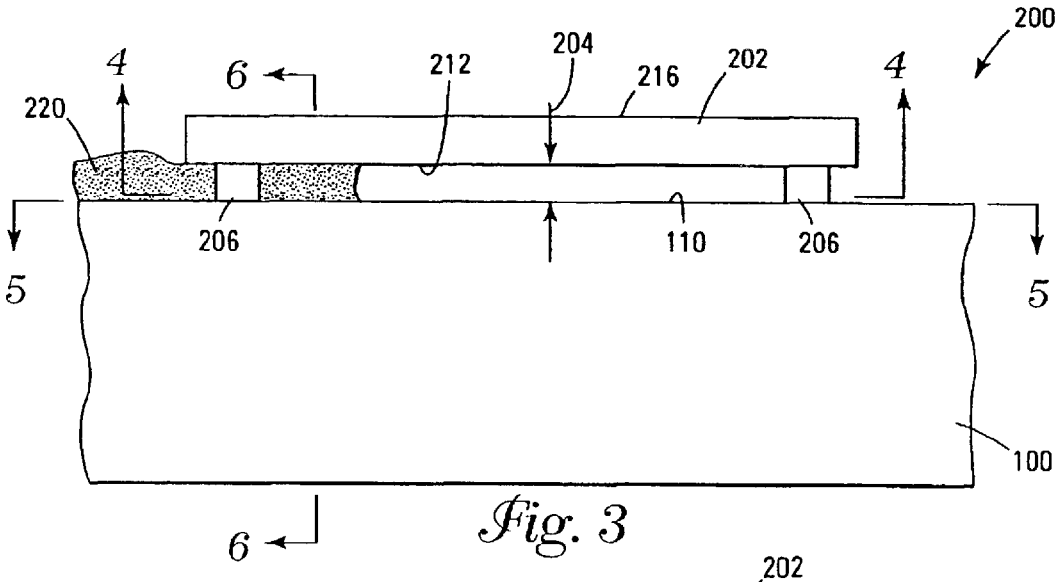
FIG. 3 is a cross-sectional view illustrating dispensing an adhesive between a carrier of the fluid-ejection device of FIG. 2 and a fluid-ejecting substrate of the fluid-ejection device of FIG. 2 according to another embodiment of the present invention.
Figure 10:
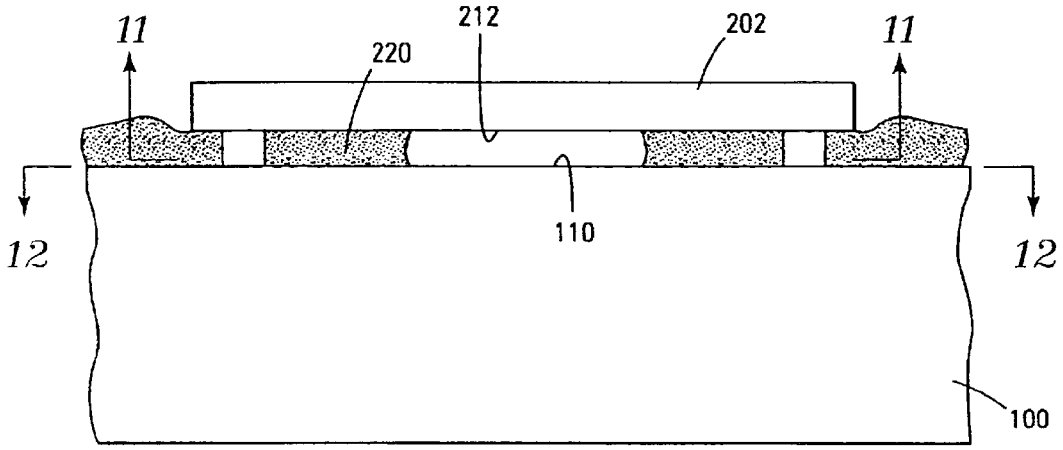
FIG. 10 is a cross-sectional view illustrating dispensing an adhesive between a carrier of the fluid-ejection device of FIG. 2 and a fluid-ejecting substrate of the fluid-ejection device of FIG. 2 according to another embodiment of the present invention.
Figure 11:
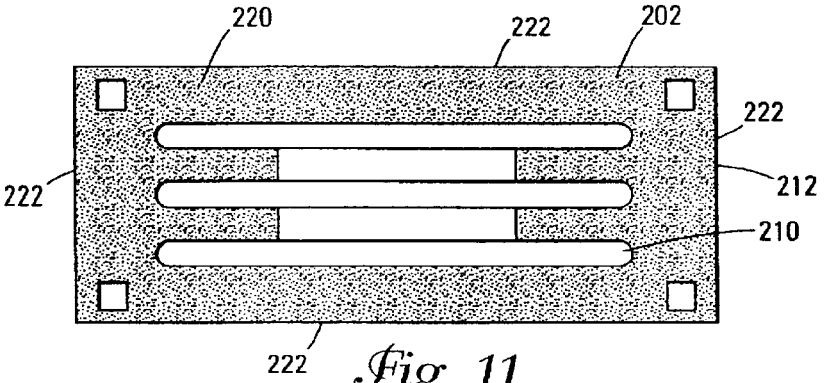
FIG. 11 is a view taken along line 11—11 of FIG. 10.
Figure 12:
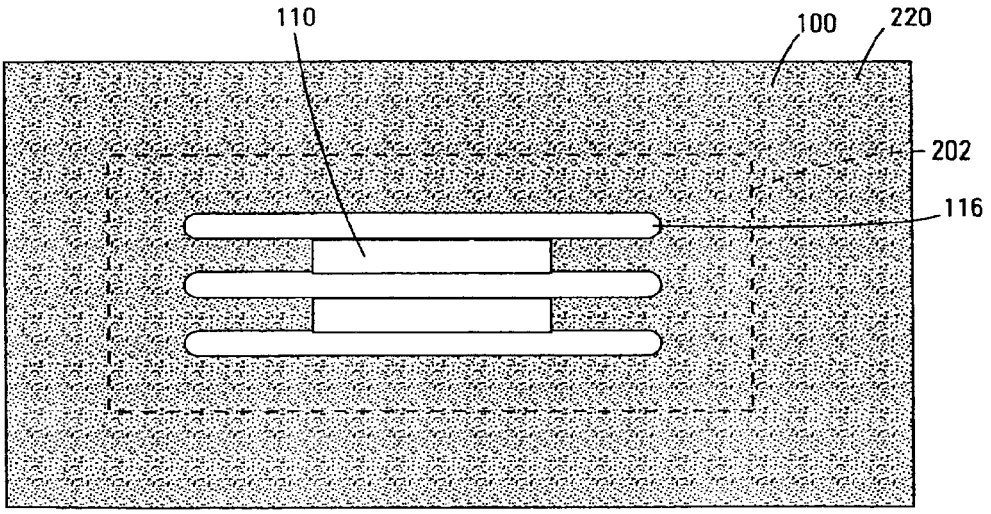
FIG. 12 is a view taken along line 12—12 of FIG. 10.

For one embodiment, capillary action draws adhesive 220 through gap 204 between fluid-ejecting substrate 202 and carrier 100 from one of edges 222 of fluid-ejecting substrate 202, as illustrated in FIGS. 3–5. For other embodiments, capillary action draws adhesive 220 through gap 204 from all of edges 222, as illustrated in FIGS. 10–12. Adhesive 220 flows over surface 212 of fluid-ejecting substrate 202 without flowing into slots 210. Adhesive 220 also flows over surface 110 of carrier 100 without flowing into channels 116.

Figure 7:
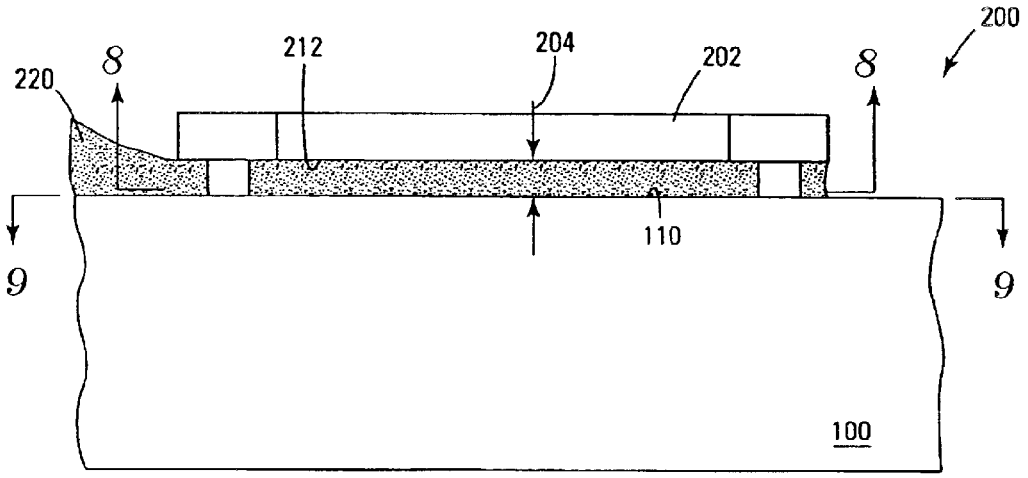
FIG. 7 is a cross-sectional view illustrating an adhesive disposed between a carrier of the fluid-ejection device of FIG. 2 and a fluid-ejecting substrate of the fluid-ejection device of FIG. 2 according to another embodiment of the present invention.
Figure 8:
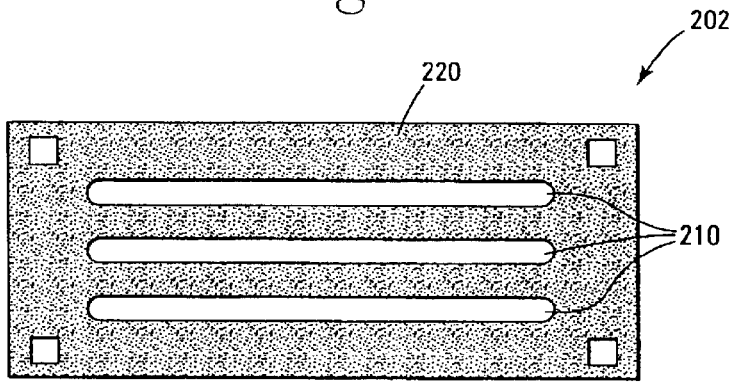
FIG. 8 is a view taken along line 8—8 of FIG. 7.
Figure 9:
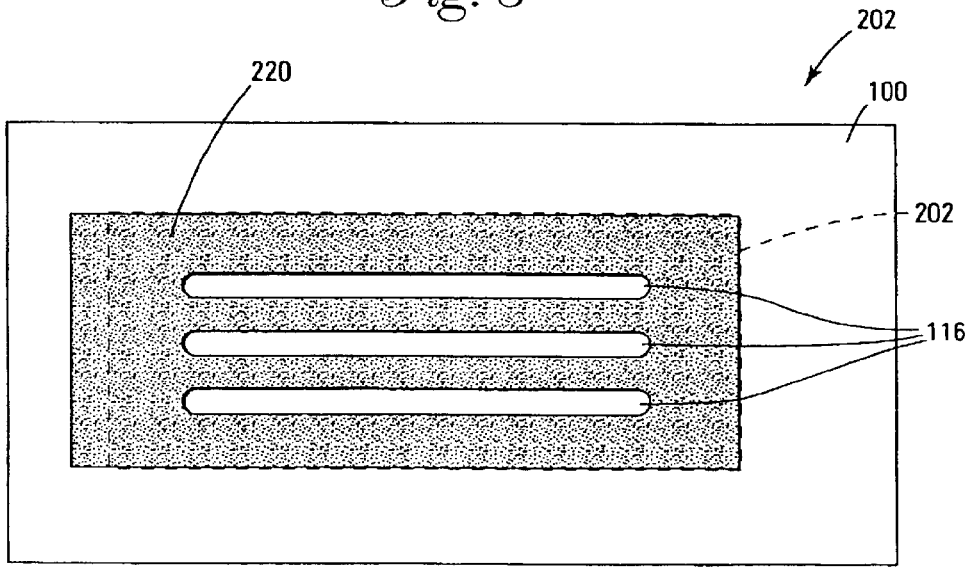
FIG. 9 is a view taken along line 9—9 of FIG. 7.

Adhesive 220 continues to flow on surfaces 110 and 212 until surface 212 and the portion of surface 110 corresponding to surface 212 are coated with adhesive 220, as shown in FIGS. 7–9 for the situation of FIGS. 3–5, i.e., where adhesive 220 is drawn from one of edges 222. For the situation of FIGS. 10–12, i.e., where adhesive 220 is drawn from all of edges 222, surfaces 110 and 212, for one embodiment, will be completely coated with adhesive 220 when adhesive 220 stops flowing. At this point, adhesive 220 is allowed to cure and/or solidify, thereby adhering fluid-ejecting substrate 202 to carrier 100.

An attractive force between molecules of adhesive 220 and surfaces 110 and 212 causes adhesive 220 to wet surfaces 110 and 212 and produces the capillary action that draws adhesive 220 through gap 204. The surface tension of adhesive 220 acts to prevent adhesive 220 from flowing into channels 116 and slots 210.

For one embodiment, the surface tension of adhesive 220 provides a self-alignment feature. That is, as adhesive 220 wets surfaces 110 and 212, the surface tension causes wetted surfaces 110 and 212 to align with each other, causing slots 210 to respectively self-align with channels 116.

For some embodiments, before drawing adhesive 220 through gap 204, adhesive 220, fluid-ejecting substrate 202, and carrier 100 are heated to a temperature, e.g., about 80° C., where the viscosity of adhesive 220 is such that the adhesive 220 flows with less resistance through gap 204 when drawn therethrough. For some embodiments, the viscosity of adhesive 220, when heated, ranges from about 30 to about 2500 centipoise. Heating can also improve the wetting of surfaces 110 and 212 by adhesive 220, thereby enabling adhesive 220 to flow better through gap 204.

Figure 13:
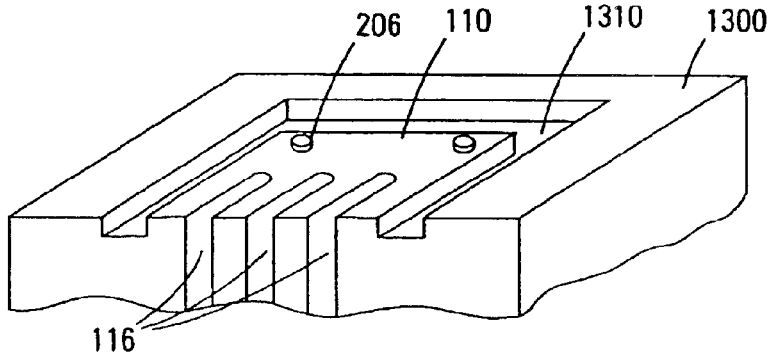
FIG. 13 is a perspective view illustrating a carrier of a fluid ejection device according to another embodiment of the present invention.

FIG. 13 illustrates a carrier 1300 of a fluid ejection device according to another embodiment of the present invention. Elements common to FIGS. 1 and 13 are numbered as in FIG. 1 and are as described above. Carrier 1300 includes a channel (or moat) 1310 disposed around surface 110 of carrier 1300. For some embodiments, moat 1310 and surface 110 are located within in a recess (or well), such as shown in FIG. 1 for carrier 100 and as described above. For other embodiments, the moat is located below surface 110 of carrier 1300, as shown in FIG. 13.

Figure 14:
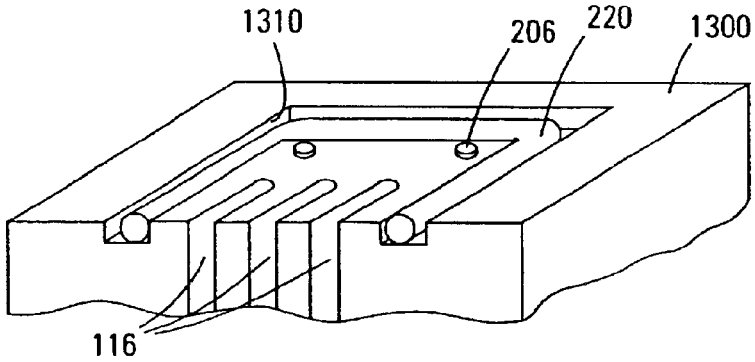
FIG. 14 is a perspective view illustrating an adhesive disposed in a moat of the carrier of FIG. 13.
Figure 15:
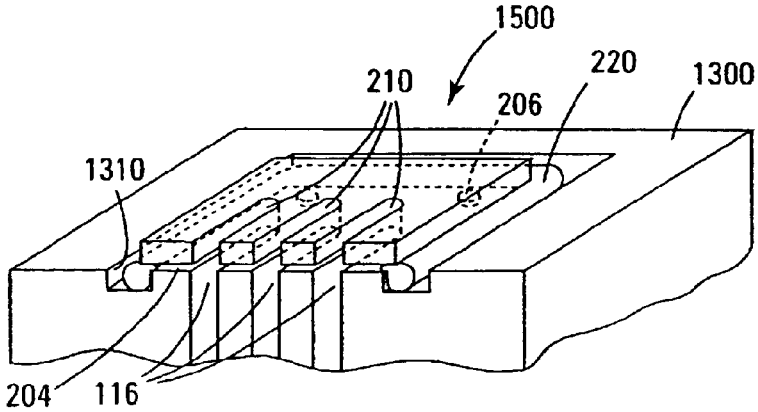
FIG. 15 is a perspective view illustrating a fluid-ejection device according to another embodiment of the present invention.
Figure 16:
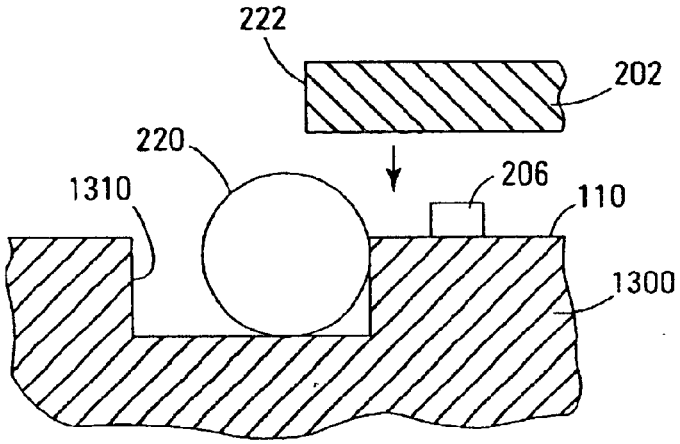
FIG. 16 is a cross-sectional view illustrating positioning a fluid-ejecting substrate of a fluid-ejection device on a carrier of the fluid-ejection device according to another embodiment of the present invention.
Figure 17:
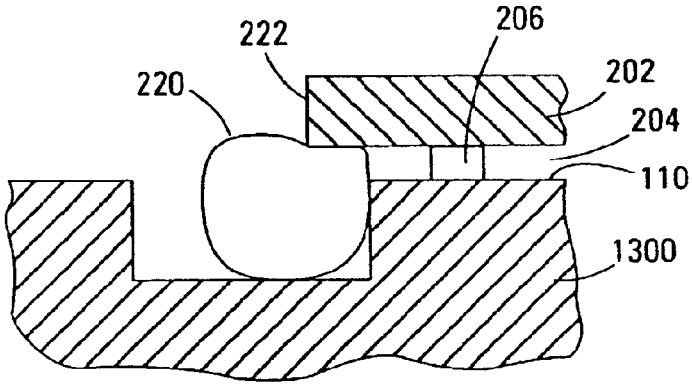
FIGS. 17 and 18 are cross-sectional views illustrating an adhesive being drawn between the fluid-ejecting substrate of FIG. 16 and the carrier of FIG. 16 according to another embodiment of the present invention.
Figure 18:
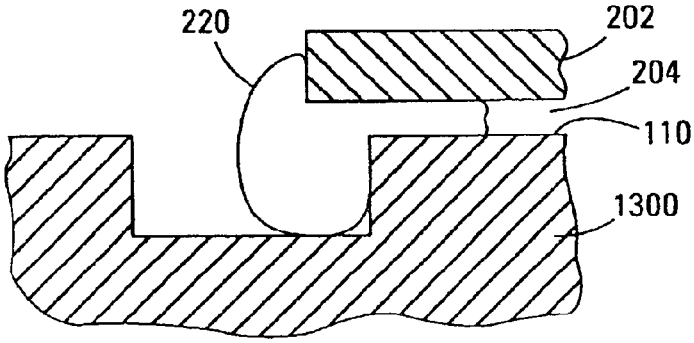

FIGS. 14–18 illustrate adhering fluid-ejecting substrate 202 to carrier 1300 to form a fluid-ejection device 1500 according to another embodiment of the present invention. Elements common to FIGS. 2–12 and FIGS. 14–18 are numbered as in FIGS. 2–12 and are as described above. Adhesive 220 is disposed in moat 1310 as shown in FIG. 14. For one embodiment, a portion of adhesive 220 protrudes above surface 110 of carrier 1300, as shown in FIG. 16, due to the surface tension of adhesive 220. For another embodiment, adhesive 220 is directed into moat 1310 through a flow passage, such as flow passage 114 shown in FIG. 2. In other embodiments, adhesive 220 may be dispensed into moat 1310 using a syringe or the like.

Fluid-ejecting substrate 202 is positioned on spacers 206 to form gap 204, as shown in FIGS. 15–18. When fluid-ejecting substrate 202 contacts adhesive 220, adhesive is drawn into gap 204 from all of edges 222 of fluid-ejecting substrate 202 by capillary action, e.g., as described above and shown in FIGS. 10–12 for fluid-ejection device 200. For one embodiment, the surface tension of adhesive 220 causes slots 210 to respectively self-align with channels 116, as described above.

Figure 19:
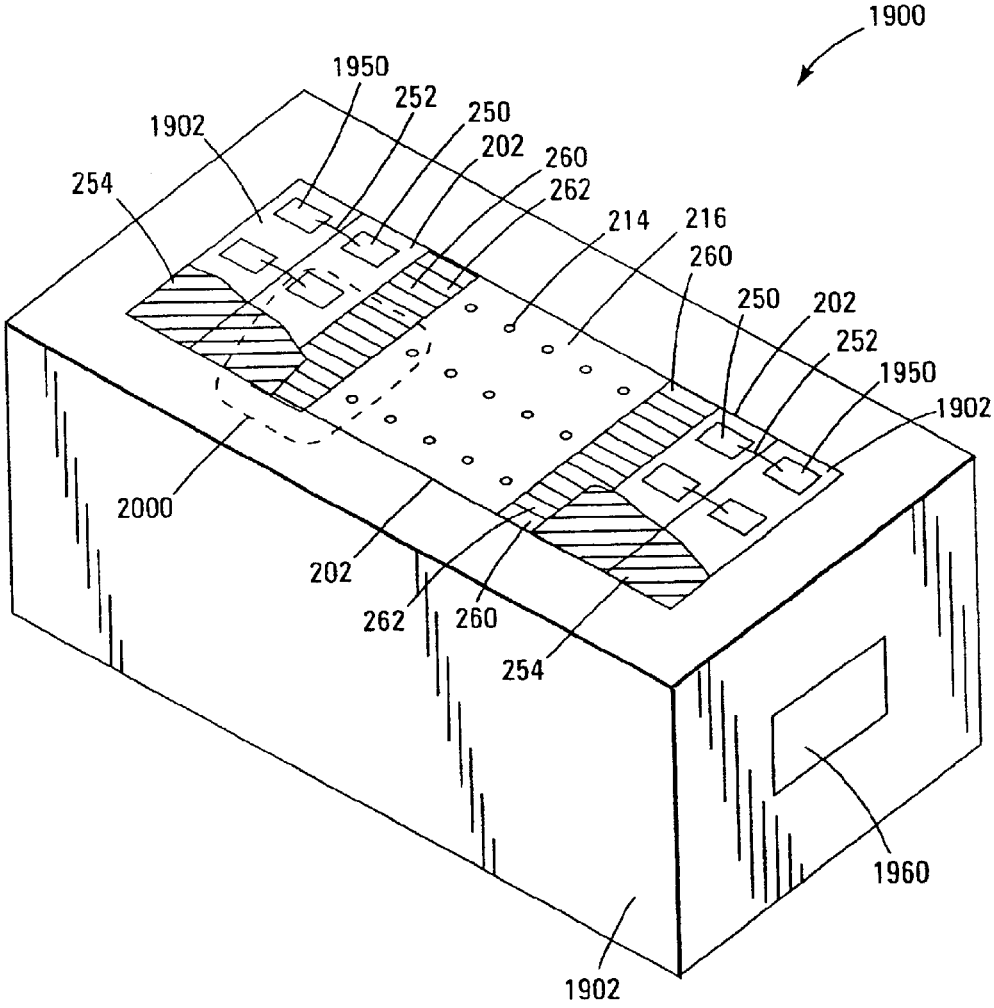
FIG. 19 is a perspective view of a fluid-ejection device according to another embodiment of the present invention.
Figure 25:
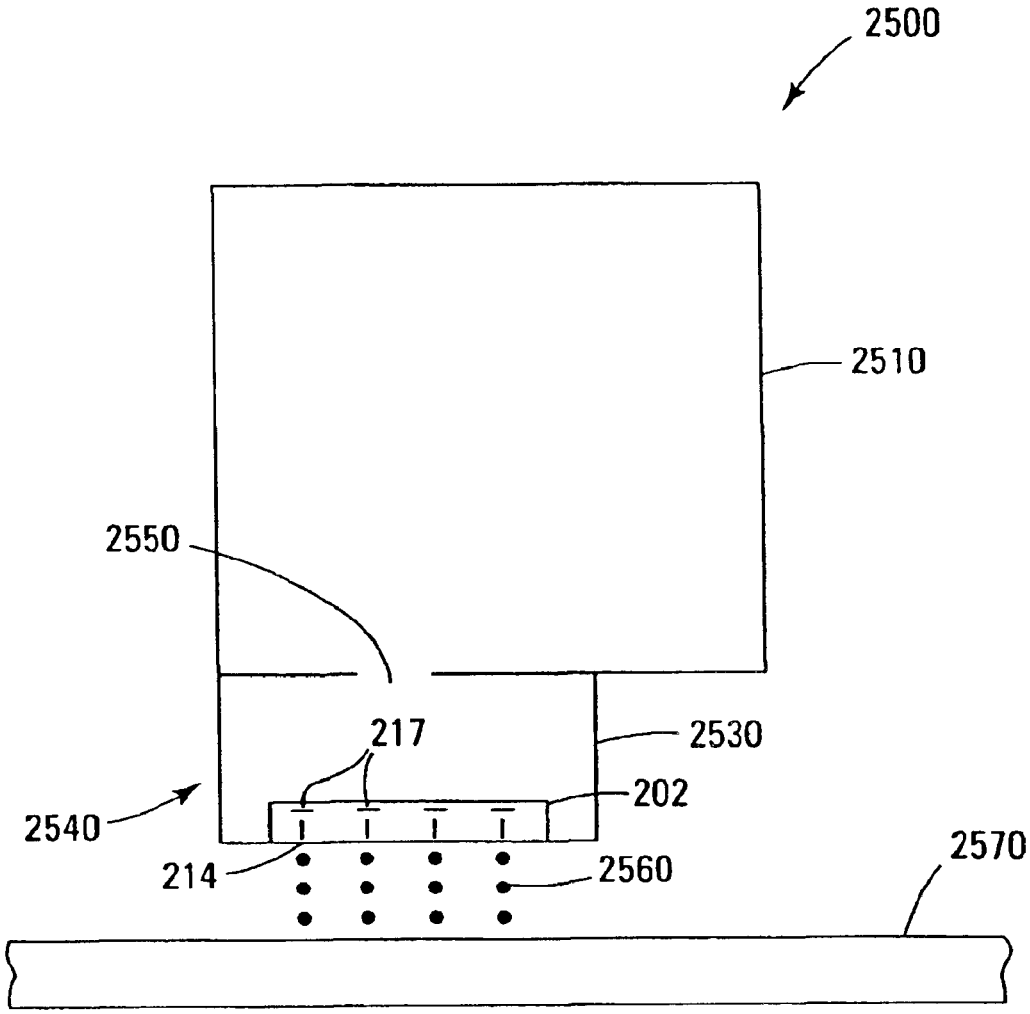
FIG. 25 illustrates a fluid-ejection cartridge according to another embodiment of the present invention.
Figure 26:
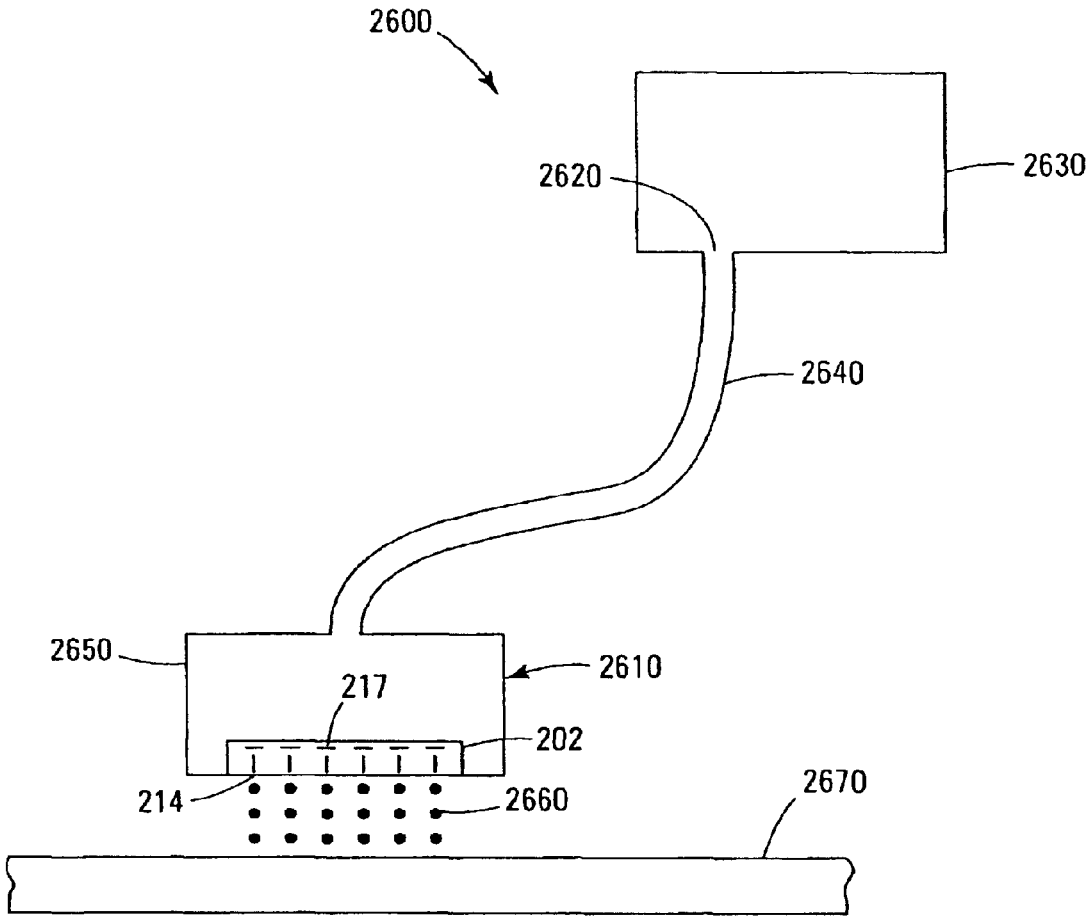
FIG. 26 illustrates a fluid deposition system according to another embodiment of the present invention.

FIG. 19 is a perspective view of a fluid-ejection device 1900. Elements common to FIGS. 1–12 and FIG. 19 are numbered as in FIGS. 1–12. Fluid-ejection device 1900 includes fluid-ejecting substrate 202 disposed on a carrier 1902. For one embodiment, carrier 1902 is as described above for carrier 100 or carrier 1300, and fluid-ejecting substrate 202 is adhered to carrier 1902 as described above for forming fluid-ejection device 200 or 1500. For one embodiment, fluid-ejecting substrate 202 includes orifices 214 in a surface 216 of fluid-ejecting substrate 202. Surface 216 is opposite surface 212, as shown in FIG. 3. For one embodiment, resistors 217 are disposed in fluid-ejecting substrate 202 adjacent each of orifices 214, as shown in FIGS. 25 and 26.

After adhering fluid-ejecting substrate 202 to carrier 1902, electrical contacts 250 of fluid-ejecting substrate 202 are electrically connected to electrical connectors 1950 of carrier 1902 using electrical interconnects 252, such as wires. Electrical contacts 250 are electrically connected to resistors 217 of fluid-ejecting substrate 202. An encapsulant 254 is disposed on electrical contacts 250, electrical connectors 1950, and electrical interconnects 252 to protect them from fluid that is ejected through orifices 214. Electrical connectors 1950 are electrically connected to an electrical terminal 1960. Electrical terminal 1960 is connected to a power source (not shown), e.g., included as a part of a printer (not shown). Electrical signals for energizing resistors 217 are conveyed from the power source to resistors 217 via electrical terminal 1960, electrical connectors 1950, electrical interconnects 252, and electrical contacts 250.

Figure 20:
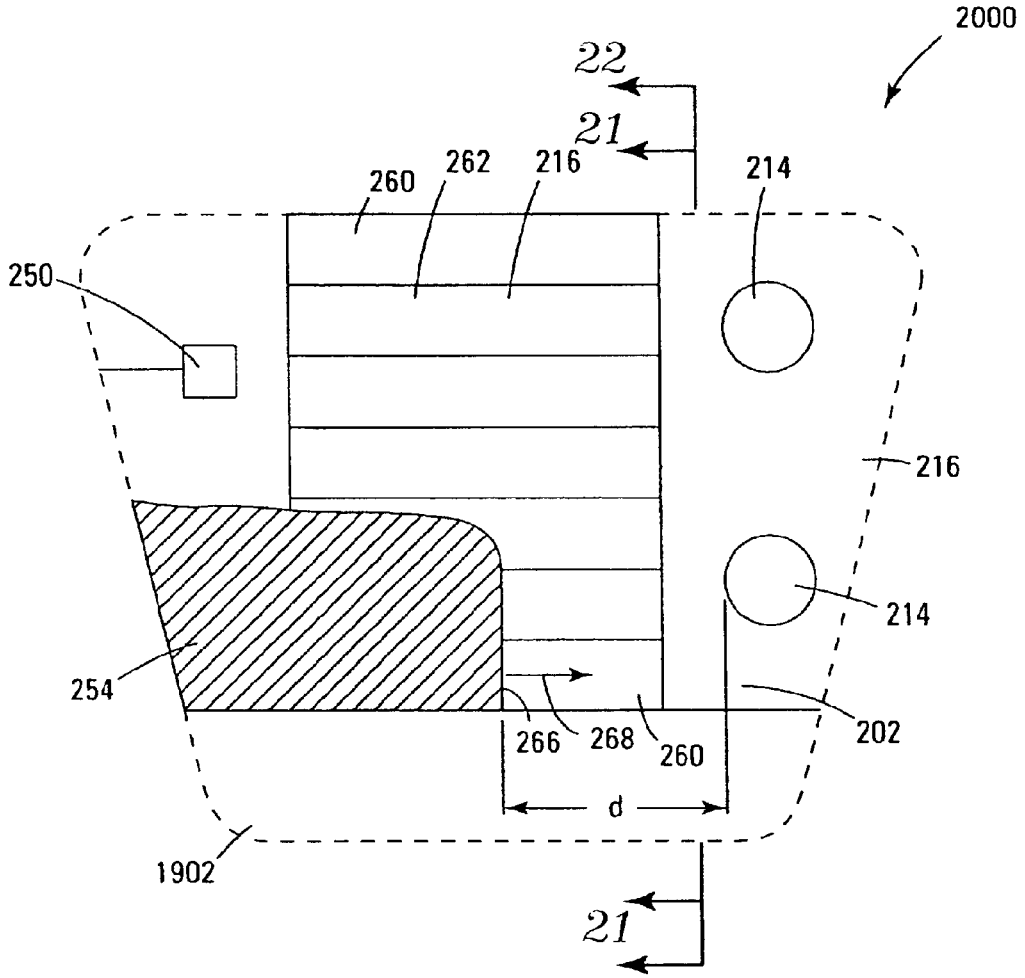
FIG. 20 is an enlarged view of region 2000 of FIG. 19.
Figure 21:
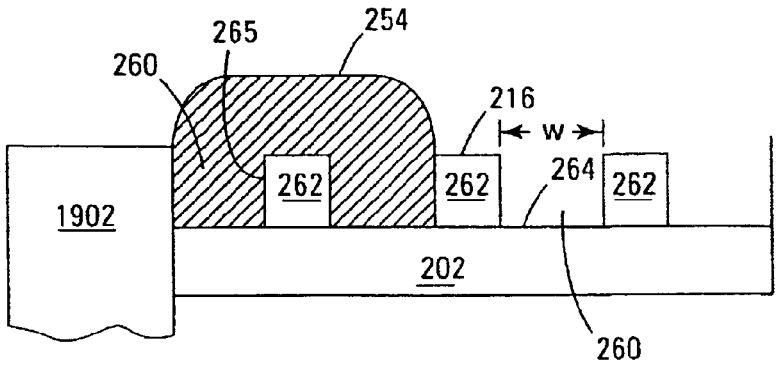
FIG. 21 is a view taken along line 21—21 of FIG. 20.

Channels 260 are disposed in surface 216 of fluid-ejecting substrate 202 between electrical connectors 250 and orifices 214, as shown in FIGS. 19 and 20, e.g., using semiconductor fabrication methods, such as etching, photolithography, or the like. Each of ribs 262 respectively separates successively adjacent channels 260. Ribs 262 extend from a base 264 of each of channels 260 to surface 216, as shown in FIGS. 21 and 22.

As encapsulant 254 is dispensed on electrical contacts 250, electrical connectors 150, and electrical interconnects 252 by directing a flow of encapsulant 254 thereon, e.g., using a syringe or the like, encapsulant 254 can spread (or flow) toward orifices 214. As encapsulant 254 flows toward orifices 214, encapsulant 254 flows over ribs 262 and in channels 260, as shown in FIGS. 20 and 21. This acts to prevent encapsulant 254 from spreading, e.g., beyond a distance d from orifices 214 located closest to channels 260, as shown in FIG. 20.

For one embodiment, encapsulant 254 includes resin and filler components. For another embodiment, the filler includes particles of silica, alumina, calcium carbonate, fumed $SiO_2$ of a controlled particle size, etc. For other embodiments, filler particle sizes can range from about 1 micron to about 50 microns. The filler acts generally to increase the viscosity of encapsulant 254. That is, the higher the filler concentration, the more viscous the encapsulant 254. For one embodiment, and as best understood with reference to FIG. 20, an attractive force between molecules of encapsulant 254 and ribs 262 produces capillary action that draws the resin from encapsulant 254, causing the resin to flow through channels 260 substantially parallel to surface 216 and away from a boundary (or front) 266 of encapsulant 254, as indicated by arrow 268 in FIG. 20. This increases the filler concentration and thus the viscosity of encapsulant 254 adjacent the boundary 266. The increased viscosity acts to control the spread of encapsulant 254. In one embodiment, the increased viscosity acts to stop the flow of encapsulant 254 at the distance d from orifices 214 located closest to channels 260. In another embodiment, the increased viscosity acts to slow the flow of encapsulant 254 so that encapsulant 254 solidifies at the distance d from orifices 214 located closest to channels 260.

Figure 22:
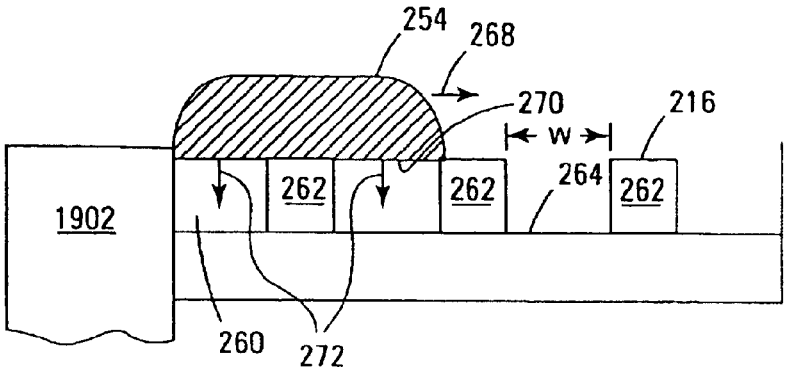
FIG. 22 is a view taken along line 22—22 of FIG. 20 illustrating another embodiment of the present invention.

For some embodiments, and as best understood with reference to FIG. 22, ribs 262 are spaced so that the width w of each of channels 260 is too small for encapsulant 254 to flow into channels 260, e.g., owing to surface tension, viscosity, etc. of encapsulant 254. In these embodiments, encapsulant 254 flows over segments of surface 216 (i.e., segments corresponding to surfaces of the ribs 262) located between channels 260 toward orifices 214, as indicated by arrow 268 in FIG. 22. Further, in these embodiments, capillary action draws resin away from a boundary 270 of encapsulant 254 that is substantially parallel to surface 216 into channels 260 toward base 264 so that the resin flows substantially perpendicular to surface 216, as indicated by arrows 272 in FIG. 22. This increases the filler concentration and thus the viscosity of encapsulant 254 adjacent the boundary 270. The increased viscosity acts to control the spread of encapsulant 254 by slowing or stopping the flow of encapsulant 254.

Figure 23:
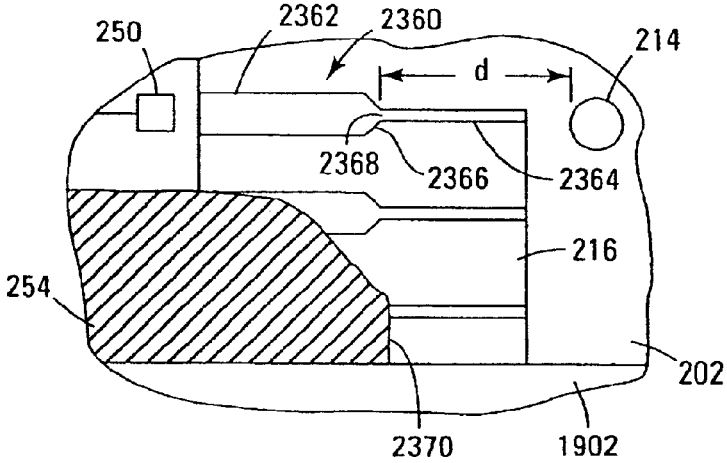
FIG. 23 illustrates channels disposed on a surface of a fluid-ejecting substrate of the fluid-ejection device of FIG. 19 according to another embodiment of the present invention.

For another embodiment, channels 2360 are disposed in surface 216 of fluid-ejecting substrate 202 between electrical connectors 250 and orifices 214, as shown in FIG. 23. Channels 2360 include channel segments 2362 and 2364 connected by a taper 2366. In this way, channel segment 2362 has a larger flow cross-section than channel segment 2364. For one embodiment, channel segment 2364 is sized so that channel segment 2364 acts to prevent particles of the filler of encapsulant 254 from flowing through channel segment 2364. For another embodiment, this is accomplished by making the flow cross-section of channel segment 2364 smaller than the particles of the filler. For other embodiments, an inlet 2368 to channel segment 2364 is at the distance d from orifices 214 located closest to channels 2360.

Encapsulant 254 flows over surface 216 in the vicinity of channels 2360 and through channel segments 2362. When encapsulant 254 encounters channel segment 2364, the filler stops generally at inlet 2368, and the resin is drawn through channel segment 2364 by capillary action. This increases the filler concentration and thus the viscosity of encapsulant 254 adjacent a boundary 2370 of encapsulant 254. Channel segments 2364 and the increased viscosity act to control the spread of encapsulant 254 by slowing or stopping the flow of encapsulant 254. In particular, for one embodiment, channel segments 2364 and the increased viscosity act to stop the flow of encapsulant 254 at the distance d, where, in other embodiments, encapsulant 254 solidifies.

Figure 24:
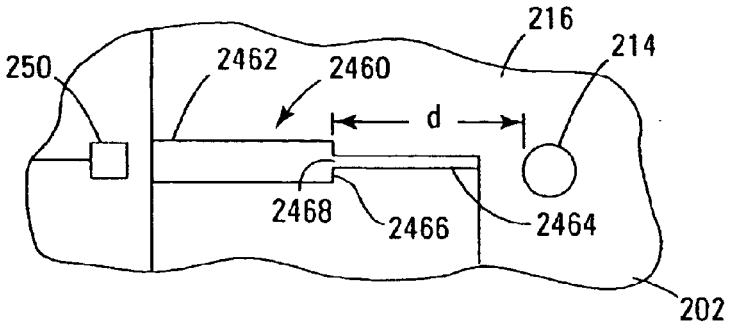
FIG. 24 illustrates a channel disposed on a surface of a fluid-ejecting substrate of the fluid-ejection device of FIG. 19 according to yet another embodiment of the present invention.

In another embodiment, the channels disposed in surface 216 of fluid-ejecting substrate 202 are as shown for channel 2460 in FIG. 24. Channel 2460 includes channel segments 2462 and 2464 connected by a step 2466. In this way, channel segment 2462 has a larger flow cross-section than channel segment 2464. For one embodiment, channel segment 2464 is sized so that channel segment 2464 acts to prevent particles of the filler of encapsulant 254 from flowing through channel segment 2464. For another embodiment, this is accomplished by making the flow cross-section of channel segment 2464 smaller than the particles of the filler. For other embodiments, an inlet 2468 to channel segment 2462 is at the distance d from orifices 214 located closest to the channels disposed in surface 216. Channel 2460 functions generally as described above for channels 2360. That is, when encapsulant 254 encounters channel segment 2464, the filler stops generally at inlet 2468, and the resin is drawn through channel segment 2464 by capillary action.

For one embodiment, the resin separates from the filler and continues to flow ahead of the concentrated filler region until the capillary force reaches equilibrium, thereby stopping resin flow. In effect, there is a resin/filler gradient, and the resin advances to create a thin, tapered layer that eventually stops because there is no additional resin supply.

FIG. 25 illustrates a fluid-ejection cartridge 2500, e.g., a print cartridge, according to another embodiment of the present invention. Elements common to FIGS. 1–19 and FIG. 25 are as described above for FIGS. 1–19. Fluid-ejection cartridge 2500 includes a fluid reservoir 2510, e.g., an ink reservoir, integral with a carrier 2530 of a fluid-ejection device 2540. For one embodiment, carrier 2530 is as described for carriers 100, 1300, or 1902, respectively of FIGS. 1, 13, and 19. For another embodiment, fluid-ejection device 2540 is as described above for fluid-ejection devices 200, 1500, or 1900, respectively of FIGS. 2, 15, and 19 and thus includes the fluid-ejecting substrate 202 described above. A flow passage 2550 fluidly couples fluid-ejection device 2540 to reservoir 2510.

In operation, fluid reservoir 2510 supplies fluid, such as ink, to fluid-ejection device 2540. Channels of carrier 2530, such as channels 116 of carrier 100 or carrier 1300, deliver the fluid to slots 210 of fluid-ejecting substrate 202. The fluid is channeled from slots 210 to resistors 217. Resistors 217 are selectively energized to rapidly heat the fluid, causing the fluid to be expelled through orifices 214 in the form of droplets 2560. For some embodiments, droplets 2560 are deposited onto a medium 2570, e.g., paper, as fluid-ejection cartridge 2500 is fixedly or movably positioned adjacent medium 2570 in an imaging device (not shown), such as a printer, fax machine, or the like.

FIG. 26 illustrates a fluid deposition system 2600, e.g., an ink deposition system, according to another embodiment of the present invention. Elements common to FIGS. 1–19 and FIG. 26 are as described above for FIGS. 1–19. Fluid deposition system 2600 includes a fluid-ejection device 2610 fluidly coupled to an outlet port 2620 of a fluid reservoir 2630, e.g., ink reservoir, by a flexible conduit 2640, such as plastic or rubber tubing or the like. For one embodiment, fluid-ejection device 2610 includes a carrier 2650 that for another embodiment is as described for carriers 100, 1300, or 1902, respectively of FIGS. 1, 13, and 19. For other embodiments, fluid-ejection device 2610 is as described above for fluid-ejection devices 200, 1500, or 1900, respectively of FIGS. 2, 15, and 19 and thus includes the fluid-ejecting substrate 202 described above.

In operation, fluid reservoir 2630 supplies fluid, such as ink, to fluid-ejection device 2610 via flexible conduit 2640. Channels of carrier 2650, such as channels 116 of carrier 100 or carrier 1300, deliver the fluid to slots 210 of fluid-ejecting substrate 202. The fluid is channeled from slots 210 to resistors 217. Resistors 217 are selectively energized to rapidly heat the fluid, causing the fluid to be expelled through orifices 214 in the form of droplets 2660. For some embodiments, droplets 2660 are deposited onto a medium 2670, e.g., paper, as fluid-ejection device 2610 is fixedly or movably positioned adjacent medium 2670 while fluid reservoir 2630 remains stationary. Flexible conduit 2640 enables fluid-ejection device 2610 to move relative to fluid reservoir 2630 in some embodiments.

CONCLUSION

Although specific embodiments have been illustrated and described herein, it will be appreciated by those of ordinary skill in the art that any arrangement that is calculated to achieve the same purpose may be substituted for the specific embodiments shown. Many adaptations of the invention will be apparent to those of ordinary skill in the art. Accordingly, this application is intended to cover any adaptations or variations of the invention. It is manifestly intended that this invention be limited only by the following claims and equivalents thereof.

What is claimed is:

1. A method for manufacturing a fluid-ejection device capable of ejecting fluid onto media, the method comprising:

adhering a fluid-ejecting substrate of the fluid-ejection device to a carrier of the fluid-ejection device by drawing an adhesive between the fluid-ejecting substrate and the carrier using capillary action.

2. The method of claim 1, further comprising aligning each of a plurality of slots of the fluid-ejecting substrate with a respective one of a plurality of channels of the carrier before drawing the adhesive between the fluid-ejecting substrate and the carrier.

3. The method of claim 1, wherein drawing the adhesive between the fluid-ejecting substrate and the carrier using capillary action causes each of a plurality of slots of the fluid-ejecting substrate to self-align with a respective one of a plurality of channels of the carrier.

4. The method of claim 1, further comprising forming a gap between the fluid-ejecting substrate and the carrier before drawing the adhesive between the fluid-ejecting substrate and the carrier, wherein drawing the adhesive between the fluid-ejecting substrate and the carrier comprises drawing the adhesive through the gap.

5. The method of claim 4, wherein forming the gap between the fluid-ejecting substrate and the carrier comprises disposing spacers between the fluid-ejecting substrate and the carrier.

6. The method of claim 1, further comprising disposing the fluid-ejecting substrate in a recess in the carrier before drawing the adhesive between the fluid-ejecting substrate and the carrier and dispensing the adhesive into the recess before drawing the adhesive between the fluid-ejecting substrate and the carrier.

7. The method of claim 6, wherein dispensing the adhesive into the recess comprises directing the adhesive through a flow passage disposed in the carrier that opens into the recess.

8. The method of claim 1, wherein drawing the adhesive between the fluid-ejecting substrate and the carrier comprises drawing the adhesive from one or more edges of the fluid-ejecting substrate.

9. The method of claim 1, wherein adhering the fluid-ejecting substrate to the carrier comprises curing the adhesive after drawing the adhesive between the fluid-ejecting substrate and the carrier.

10. The method of claim 1, further comprising heating the adhesive, the fluid-ejecting substrate, and the carrier before drawing the adhesive between the fluid-ejecting substrate and the carrier.

11. The method of claim 1, further comprising dispensing the adhesive into a moat in the carrier before drawing the adhesive between the fluid-ejecting substrate and the carrier.

12. The method of claim 11, further comprising bringing the fluid-ejecting substrate into contact with the adhesive contained within the moat before drawing the adhesive between the fluid-ejecting substrate and the carrier, wherein bringing the fluid-ejecting substrate into contact with the adhesive causes the adhesive to be drawn between the fluid-ejecting substrate and the carrier.

13. A method for manufacturing a fluid-ejection device capable of ejecting fluid onto media, the method comprising:

forming a gap between a first surface of a fluid-ejecting substrate of the fluid-ejection device and a second surface of a carrier of the fluid ejection device, wherein the first surface surrounds a plurality of slots in the fluid-ejecting substrate and the second surface surrounds a plurality of channels in the carrier; and drawing an adhesive through the gap using capillary action so as to distribute the adhesive over the first and second surfaces and so that the adhesive does not flow into the slots or the channels, wherein the adhesive is for adhering the fluid-ejecting substrate to the carrier at the first and second surfaces.

14. The method of claim 13, wherein drawing the adhesive through the gap comprises drawing the adhesive from one or more edges of the fluid-ejecting substrate.

15. The method of claim 13, wherein forming the gap between the first and second surfaces comprises disposing spacers between the first and second surfaces.

16. The method of claim 13, further comprising dispensing the adhesive into a moat disposed in the carrier around the second surface before drawing the adhesive through the gap.

17. The method of claim 16, wherein forming the gap comprises bringing the fluid-ejecting substrate into contact with the adhesive contained within the moat, wherein bringing the fluid-ejecting substrate into contact with the adhesive causes the adhesive to be drawn through the gap.

18. A method for manufacturing a fluid-ejection device capable of ejecting fluid onto media, the method comprising:

disposing a fluid-ejecting substrate of the fluid-ejection device in a recess of a carrier of the fluid-ejection device to form a gap between a first surface of the fluid-ejecting substrate and a second surface of the recess, wherein the first surface surrounds a plurality of slots in the fluid-ejecting substrate and the second surface surrounds a plurality of channels in the carrier;

dispensing an adhesive into the recess; and drawing the adhesive from at least one edge of the fluid-ejecting substrate through the gap using capillary action so as to distribute the adhesive over the first and second surfaces and so that the adhesive does not flow into the slots or the channels, wherein the adhesive is for adhering the fluid-ejecting substrate to the carrier at the first and second surfaces.

19. The method of claim 18, wherein dispensing the adhesive into the recess comprises directing the adhesive through a flow passage disposed in the carrier that opens into the recess.

20. The method of claim 18, further comprising aligning each of the plurality of slots with a respective one of the plurality of channels before dispensing the adhesive into the recess.

21. The method of claim 18, wherein drawing the adhesive through the gap using capillary action causes each of the plurality of slots to self-align with a respective one of the plurality of channels.

22. The method of claim 18, wherein dispensing the adhesive into the recess comprises dispensing the adhesive into a moat disposed within the recess and around the second surface before disposing the fluid-ejecting substrate in the recess, wherein disposing the fluid-ejecting substrate in the recess comprises bringing the fluid-ejecting substrate into contact with the adhesive contained within the moat, wherein bringing the fluid-ejecting substrate into contact with the adhesive causes the adhesive to be drawn through the gap.

23. A method for manufacturing a fluid-ejection device capable of ejecting fluid onto media, the method comprising:

forming a moat in a carrier of the fluid-ejection device around a first surface of the carrier, wherein the first surface surrounds a plurality of channels in the carrier;

dispensing an adhesive into the moat;

bringing a fluid-ejecting substrate of the fluid-ejection device into contact with the adhesive contained within the moat, wherein the fluid-ejecting substrate has a second surface surrounding a plurality of slots in the fluid-ejecting substrate; and drawing the adhesive from at least one edge of the fluid-ejecting substrate through a gap between the first and second surfaces using capillary action in response to contacting the adhesive with the fluid-ejecting substrate so as to distribute the adhesive over the first and second surfaces and so that the adhesive does not flow into the slots or the channels, wherein the adhesive is for adhering the fluid-ejecting substrate to the carrier at the first and second surfaces.

24. The method of claim 23, wherein dispensing the adhesive into the moat comprises directing the adhesive through a flow passage disposed in the carrier.

25. The method of claim 23, wherein drawing the adhesive through the gap using capillary action causes each of the plurality of slots to self-align with a respective one of the plurality of channels.

26. The method of claim 23, wherein forming the moat in the carrier around the first surface of the carrier comprises forming the moat below the level of the first surface.

27. A method for controlling a flow of a multi-component fluid over a surface, the method comprising:

increasing a viscosity of the multi-component fluid by drawing a component from the multi-component fluid by capillary action into one or more channels disposed in the surface, wherein increasing the viscosity acts to control the flow of the multi-component fluid by slowing or stopping the flow of the multi-component fluid.

28. The method of claim 27, further comprising directing the multi-component fluid into the one or more channels before drawing the component from the multi-component fluid.

29. The method of claim 27, wherein increasing the viscosity of the multi-component fluid by drawing the component from the multi-component fluid by capillary action into the one or more channels comprises directing the multi-component fluid through a first channel segment of the one or more channels and drawing the component through a second channel segment of the one or more channels that is connected to the first channel segment and that has a smaller flow cross-section than the first channel segment.

30. The method of claim 27, wherein drawing the component from the multi-component fluid into one or more channels comprises flowing the component substantially parallel to the surface within the one or more channels.

31. The method of claim 27, wherein drawing the component from the multi-component fluid into one or more channels comprises drawing the component into the one or more channels so that the component is substantially perpendicular to the surface and a boundary of the multi-component fluid.

32. The method of claim 27, wherein drawing the first component from the multi-component fluid into one or more channels comprises drawing a resin from a multi-component encapsulant.

33. The method of claim 32, wherein drawing the first component from the multi-component fluid into one or more channels increases a filler concentration of the multi-component encapsulant.

34. A method for encapsulating electrical elements of a fluid-ejection device capable of ejecting fluid onto media, the method comprising:

forming a plurality of channels in a surface of a fluid-ejecting substrate of the fluid-ejection device between the electrical elements and a plurality of orifices of the fluid-ejecting substrate;

directing a flow of encapsulant onto the electrical elements; and controlling spreading of the encapsulant over the surface using the plurality of channels if the encpsulant spreads to the plurality of channels by increasing a viscosity of the encapsulant by drawing a resin from the encapsulant by capillary action into one or more of the plurality of channels.

35. The method of claim 34, wherein controlling spreading of the encapsulant over the surface comprises one of stopping or slowing spreading of the encapsulant.

36. The method of claim 34, wherein forming the plurality of channels in the surface of the fluid-ejecting substrate comprises forming channels comprising first and second interconnected channel segments, wherein a flow cross-section of the first channel segment is larger that a flow cross-section of the second channel segment.

37. The method of claim 36, wherein forming channels comprising first and second interconnected channel segments comprises sizing the second channel segment so that the second channel segment acts to prevent a filler of the encapsulant from flowing through the second channel segment.

38. The method of claim 36, wherein forming channels comprising first and second interconnected channel segments comprises sizing the second channel segment so that the flow cross-section of the second channel segment is smaller than particles of a filler of the encapsulant.

39. The method of claim 36, wherein forming channels comprising first and second interconnected channel segments comprises interconnecting the first and second interconnected channel segments with a taper or a step.

40. The method of claim 36, wherein increasing the viscosity of the encapsulant by drawing the resin from the encapsulant by capillary action into one or more of the plurality of channels comprises directing the encapsulant through the first channel segment and drawing the resin through the second channel segment.

41. A fluid-ejecting substrate comprising:

means for expelling the fluid from the fluid-ejecting substrate;

means for electrically connecting the fluid expelling means to a power source;

means for producing capillary action for drawing a resin from an encapsulant so as to increase a viscosity of the encapsulant for controlling spreading of the encapsulant when the encapsulant is disposed on the electrical connecting means and if the encapsulant spreads toward the fluid-ejecting means.

42. The fluid-ejecting substrate of claim 41, wherein the fluid expelling means comprises a plurality of orifices and a plurality of electrical resistors.

43. The fluid-ejecting substrate of claim 41, wherein the means for producing capillary action comprises a plurality of channels disposed in a surface of the fluid-ejecting substrate.

44. The fluid-ejecting substrate of claim 41, wherein the fluid-ejecting substrate is fluidly and electrically coupled to a print cartridge.

45. The fluid-ejecting substrate of claim 41, wherein the fluid-ejecting substrate is fluidly and electrically coupled to a carrier of a print head.

46. The fluid-ejecting substrate of claim 45, wherein the print head is fluidly coupled to an ink reservoir by a flexible conduit.

47. A fluid-ejection device comprising:

a carrier;

a fluid-ejecting substrate disposed on the carrier and fluidly and electrically coupled to the carrier; and a plurality of channels disposed in a surface of the fluid-ejecting substrate between electrical contacts of the fluid-ejecting substrate and a plurality of orifices in the surface of the fluid-ejecting substrate.

48. The fluid-ejection device of claim 47, further comprising an encapsulant disposed over the electrical contacts.

49. The fluid-ejection device of claim 48, wherein the encapsulant extends over a portion of the plurality of channels.

50. The fluid-ejection device of claim 48, wherein channels are for producing capillary action for drawing a resin from the encapsulant so as to increase a viscosity of the encapsulant for controlling spreading of the encapsulant when the encapsulant is disposed on the electrical contacts.

51. The fluid-ejection device of claim 47, further comprising electrical connectors, disposed on a surface of the carrier, that are connected to the electrical contacts by electrical interconnects.

52. The fluid-ejection device of claim 47, further comprising resistors disposed in the fluid-ejecting substrate adjacent the orifices and electrically connected to the electrical contacts.

* * * * *

UNITED STATES PATENT AND TRADEMARK OFFICE

CERTIFICATE OF CORRECTION

PATENT NO. : 6,902,260 B2
APPLICATION NO. : 10/626065
DATED : June 7, 2005
INVENTOR(S) : Chris Aschoff et al.

It is certified that error appears in the above-identified patent and that said Letters Patent is hereby corrected as shown below:

In column 11, line 32, in Claim 34, delete “encpsulant” and insert -- encapsulant --, therefor.

Signed and Sealed this

Fourth Day of August, 2009

John Doll

JOHN DOLL
*Acting Director of the United States Patent and Trademark Office*